United States Patent [19]

Sheets

[11] 4,113,181

[45] * Sep. 12, 1978

[54] HIGH RISE SPRINKLERS

[76] Inventor: Kerney T. Sheets, P.O. Box 637, Duplessis, La. 70728

[ * ] Notice: The portion of the term of this patent subsequent to Mar. 29, 1994, has been disclaimed.

[21] Appl. No.: 758,648

[22] Filed: Jan. 12, 1977

Related U.S. Application Data

[60] Continuation-in-part of Ser. No. 603,457, Aug. 11, 1975, Pat. No. 4,014,502, which is a division of Ser. No. 439,323, Feb. 4, 1974, abandoned.

[51] Int. Cl.[2] ..... B05B 15/10

[52] U.S. Cl. ..... 239/206

[58] Field of Search ..... 239/203–206, 239/226

[56] References Cited

U.S. PATENT DOCUMENTS

| | | | |
|---|---|---|---|
| 2,585,782 | 2/1952 | Johnson | 239/205 |
| 3,709,435 | 1/1973 | Sheets | 239/204 |
| 3,921,911 | 11/1975 | Sheets | 239/206 |
| 4,014,502 | 3/1977 | Sheets | 239/206 |

*Primary Examiner*—John J. Love

*Attorney, Agent, or Firm*—David L. Ray

[57] ABSTRACT

High rising projectable sprinklers which rise automatically from the ground when water is supplied under pressure to the sprinklers. The projectable sprinklers include a generally cylindrical housing closed at the bottom and sunken in the ground, a projectable float which floats upward within the housing when water is supplied under pressure to the sprinkler, and a sprinkler head including a rotating nozzle or nozzles attached to the top of the float.

16 Claims, 8 Drawing Figures

HIGH RISE SPRINKLERS

CROSS-REFERENCE TO RELATED APPLICATIONS

This application is a continuation-in-part of application Ser. No. 603,457 filed Aug. 11, 1975, now U.S. Pat. No. 4,014,502, which is a division of application Ser. No. 439,323 filed Feb. 4, 1974, now abandoned.

BACKGROUND OF THE INVENTION

The present invention relates to high rising projectable sprinklers with a rotating nozzle or nozzles which are automatically projected or advanced to a position above the surrounding ground level when water is supplied under pressure to the sprinkler.

The advantages of a projectable sprinkler include avoidance in a lawn, farm or orchard of a permanently raised fixture which causes accidents, which is unsightly and around which the grass must be edged or clipped by hand, and avoidance of damage to a sprinkler system by children playing with a permanent, elevated standpipe, or by accidently hitting such a standpipe with a lawn mower, tractor or car.

To realize such advantages, many forms of projectable sprinklers have been proposed, both commercially and in the patent literature. U.S. Pat. Nos. 3,104,822; 2,611,644; 2,013,849 and my U.S. Pat. No. 3,709,435 disclose various types of projectable sprinklers.

One difficulty encountered in making a commercially successful projectable sprinkler has been the complexity and number of parts required. Most sprinklers are costly to manufacture, difficult to assemble, repair, and service, and are unreliable in operation. In addition, some prior art sprinklers have suffered from the inability to seal well, thus causing an unnecessarily large drop in pressure so that fewer projectable sprinklers than permanently raised sprinklers could be used on a supply line of a given hydraulic capacity.

An additional problem encountered in some prior art projectable lawn sprinklers is that to prevent the standpipe projected from the ground from rocking it was necessary to have the relatively movable parts fit one another quite closely and to have lengthy bearing surfaces, i.e., lands. On the other hand, when the parts fit closely, substantial friction developed and foreign matter tended to stick between the parts. This sometimes jammed the standpipe and at other times scored the parts so as to permit leakage to develop. Furthermore, the use of long lands required additional effort to raise the standpipe and made it more vulnerable to jamming.

Further disadvantages of some prior art projectable lawn sprinklers were that they did not tend to assume and maintain the same predetermined substantially vertical position each time they were erected, that they did not erect to great heights because clearances and friction were multiplied when the movement of the standpipe from retracted to extended position became appreciable, and that grass would frequently grow over the top of the projectable lawn sprinkler and prevent the sprinkler from rising.

Furthermore, some prior art lawn sprinklers could not be advanced or projected above the ground when the housing of the sprinkler was filled with water, and thus the area wetted by the sprinkler was undesirably small.

THE INVENTION

The high rising, projectable sprinklers of the present invention include a projectable float having a sprinkler head attached to the top end thereof, a housing in which the projectable float moves, and a water supply attached to the sprinkler head.

DESCRIPTION OF THE PREFERRED EMBODIMENTS

Figure 1:
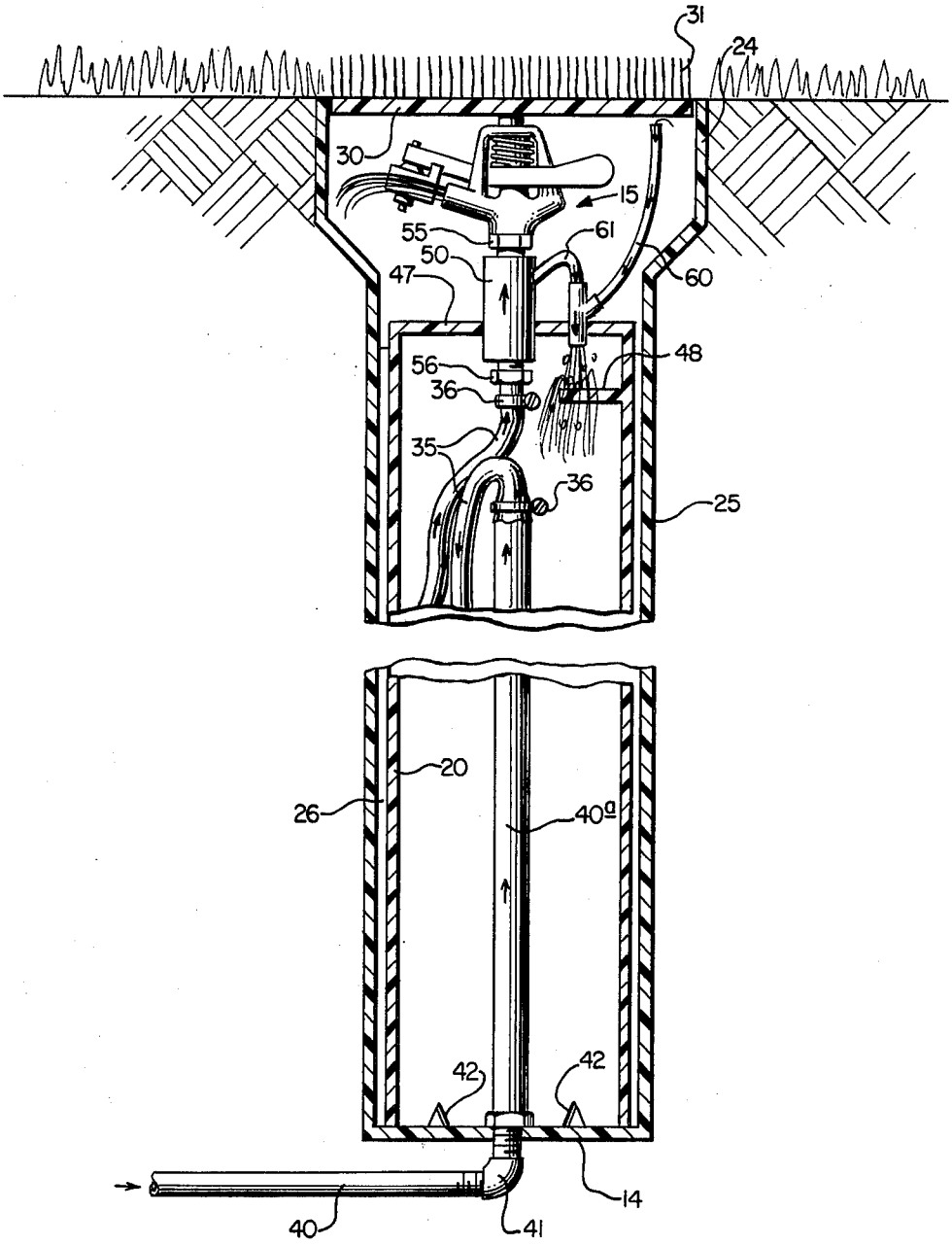
FIG. 1 is a partly sectional side view of a projectable sprinkler in a submerged position, the sprinkler having no liquids therein.

Referring now to the drawings, and in particular drawings 1 thru 4, the projectable sprinkler of the present invention can be seen to be contained in housing 25 having base 14 which is sunken into the ground so that lid 30 having simulated grass 31 thereon is at the surface of the ground. At the upper end of housing 25 is enlarged portion 24 upon which lid 30 rests.

The high rising projectable sprinkler is thus completely enclosed in a water-tight assembly defined by base 14, housing 25, and enlarged portion 24. Water, or any other liquid can only enter the sprinkler through the water supply source and around the edges of lid 30.

Figure 2:
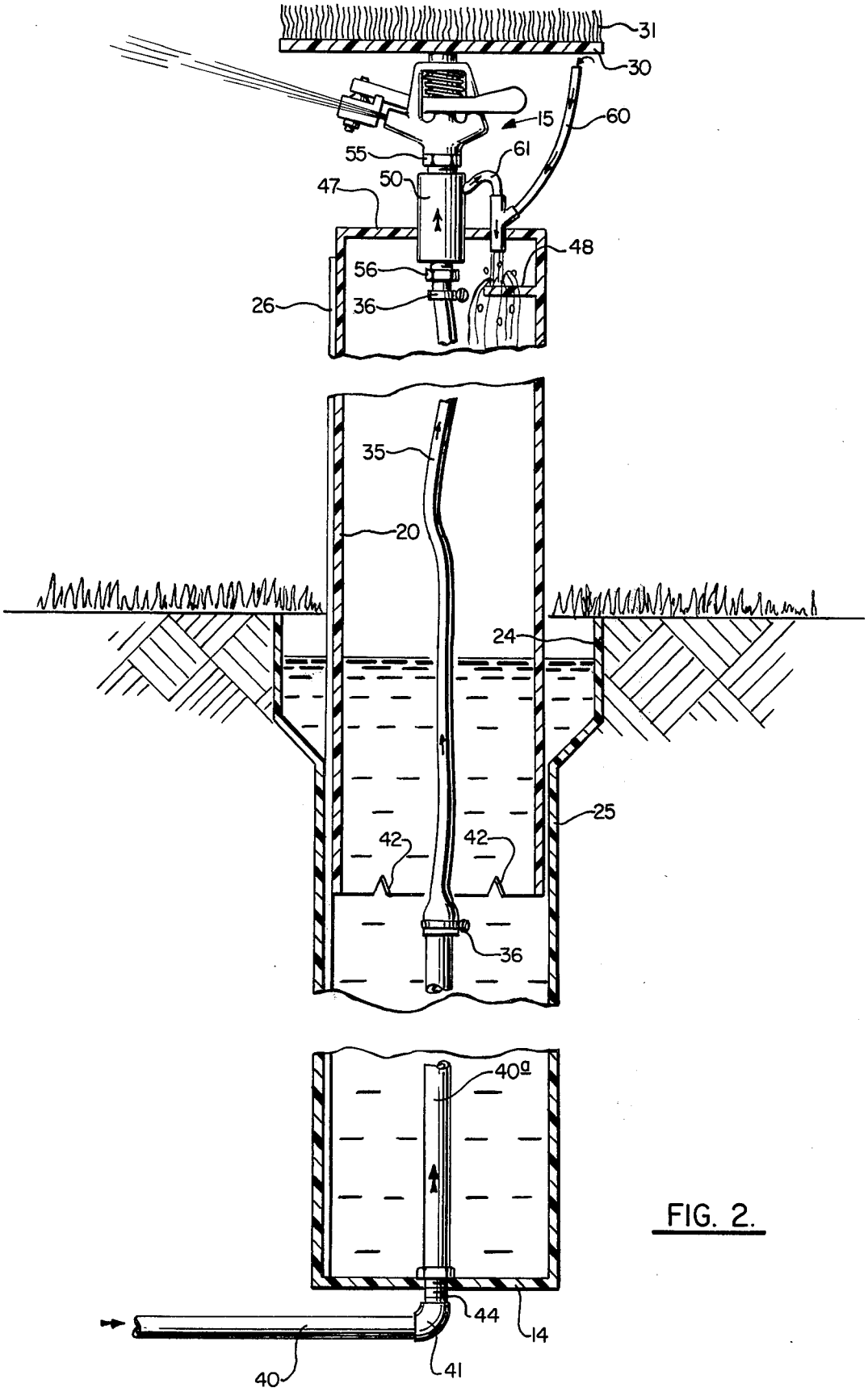
FIG. 2 is a partly sectional side view of a projectable sprinkler in the projected position.
Figure 3:
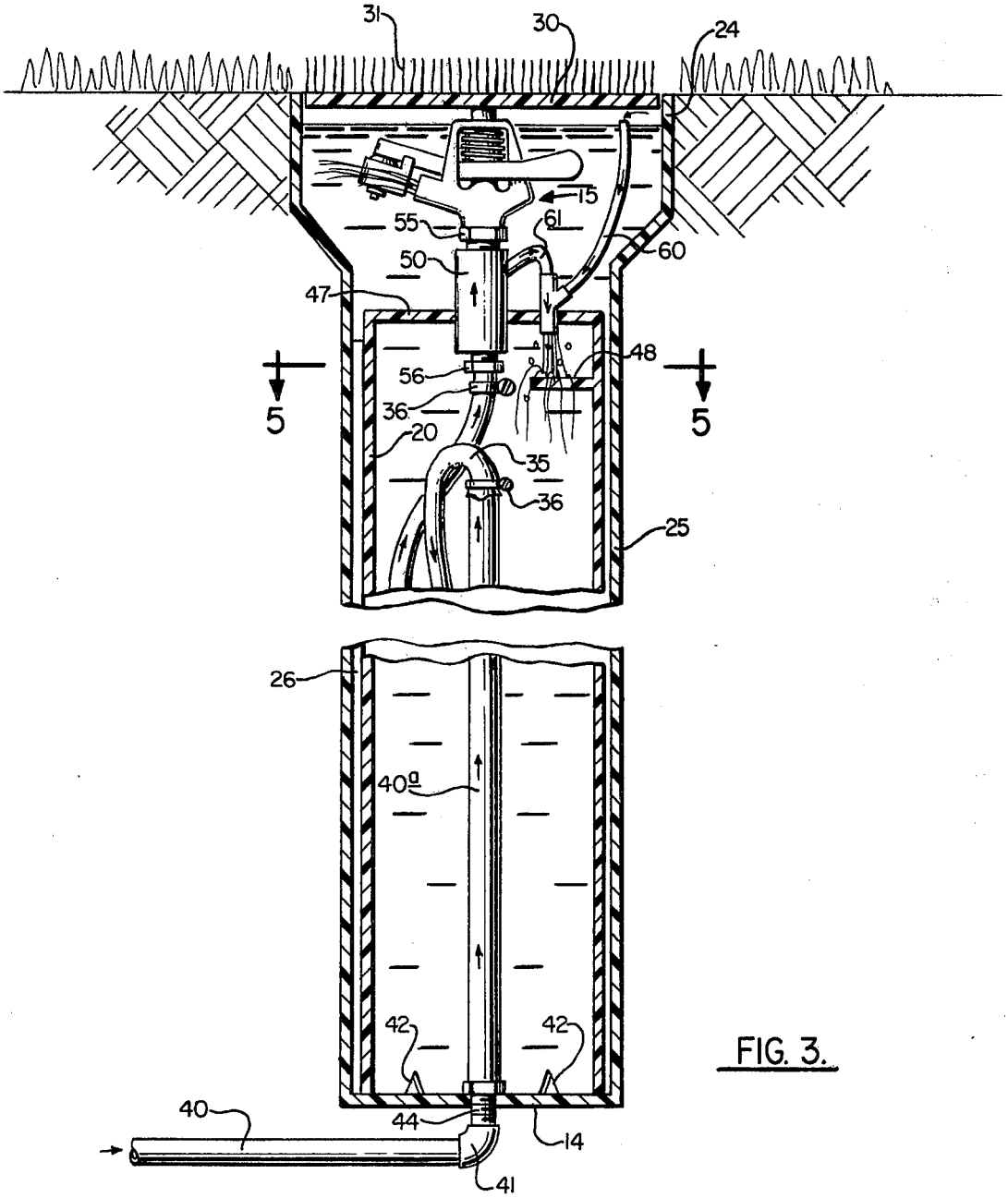
FIG. 3 is a partly sectional side view of a projectable sprinkler in a submerged position filled with liquid.

As seen in FIGS. 1 thru 3A, located inside housing 25 is projectable float 20 which floats upward within housing 25. As can be seen in FIGS. 3, projectable float 20 has a sprinkler head, indicated generally by the numeral 15, connected at the top 47 thereof. Preferably, float 20 has notches 42 in the bottom thereof to decrease or eliminate any wobbling of float 20 as air flows out the bottom thereof, although the notches may be eliminated if desired.

In the embodiment shown in FIGS. 1, 2, 3, and 3A, the projectable float 20 is connected to a water supply pipe 40. Pipe 40 is a rigid pipe which is in turn rigidly connected to the bottom 14 of housing 25 and to a source for supplying water under pressure (not shown) by a hose or any other suitable connector.

Located immediately above bottom 14 is vertical pipe **40*a*. Pipe 40*a* is a rigid pipe and preferably extends to approximately ½ the height of housing 25** to eliminate an unnecessarily long length of hose coiled in the bottom of the housing when the sprinkler is in a retracted position.

Connected to pipe **40*a* is flexible hose 35. The upper end of hose 35 is secured to float 20 by clamp 36, connector 56 and coupling 50. Thus the length of the hose 35 limits the height of float 20. Pipe 40*a* can be eliminated and hose 35 connected directly to the bottom 14 of housing 25 if desired, and the total length of hose 35 will limit the height of float 20**.

Returning now to FIGS. 1 thru 4, water supply pipe 40 is connected through coupling 41 to connector 44, pipe 40*a*, hose 35, connector 56, and coupling 50 which is rigidly connected to the top 47 of float 20. Hose 35 is secured to pipe 40*a* and connector 56 by clamps 36. Coupling 50 is rigidly attached to float 20 by any suitable means, such as gluing, welding, screwing, etc. Channel 51*a* in connector 56 is in alignment with channel 51 in coupling 50.

Figure 4:
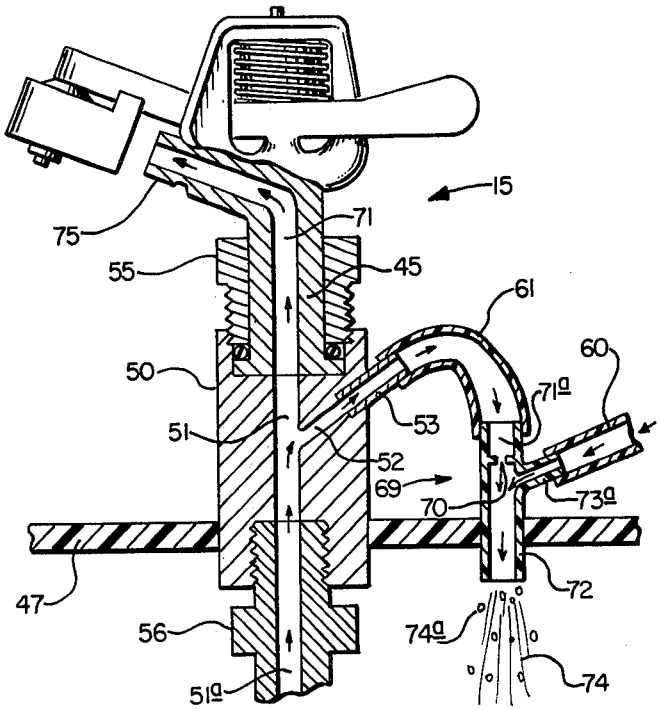
FIG. 4 is a partly sectional side view showing details of a rotating sprinkler head attached to the float.

As can be seen in FIG. 4, coupling 50 has a hollow channel 51 therein through which water flows in an upward direction when water is supplied under pressure to sprinkler head 15. Connected at the top end of coupling 50 is coupling insert 55. Coupling insert 55 is generally cylindrical in shape and is preferably threadably connected to coupling 50, which is also generally cylindrical in shape. Coupling insert 55 may also be glued to coupling 50, or attached by any other suitable means. At the upper end of coupling 50 is located a conventional sprinkler head 15 such as that shown in U.S. Pat. No. 3,309,025, for example.

As can best be seen in FIG. 4, located in rotating stem 45 is channel 71 which is in alignment with channel 51. At the upper end of channel 71 is located nozzle 75 which is a hollow opening through which water from channel 71 flows when water is supplied under pressure to sprinkler head 15.

Also located in coupling 50 is outlet channel 52 having aligned therewith insert 53 to which is connected flexible tubing 61. Connected to the other end of flexible tubing 61 is a pump structure generally indicated by the numeral 69, shown in detail in FIG. 4. At the upper end of pump 69 is located inlet 71*a* through which water flows in the direction indicated by the arrow.

Figure 6:
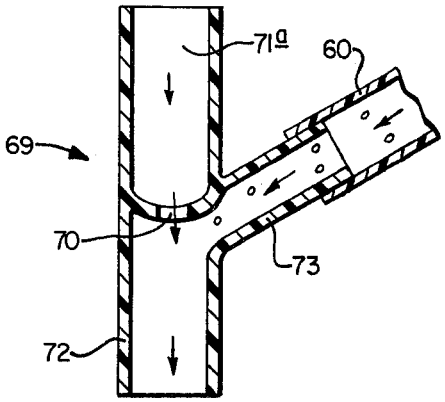
FIG. 6 is a detailed, sectional view of a structure for pumping air into the float; and, FIG. 7 is a partly sectional side view of another embodiment of the present invention.

As can be seen in FIGS. 4 and 6, at the lower end of channel 71*a* is located jet 70 which is a hollow opening through which water from channel 71*a* flows when water is supplied under pressure to sprinkler 15. As water flows through jet 70, as indicated by the arrows, air is drawn or pumped through flexible tube 60 and through inlet 73, assuming the end of flexible tube 60 is above the liquid level within enlarged portion 24. If the liquid level is below the end of flexible tube 60, air will be drawn or pumped into flexible tube 60 and inlet 73, mixed with the water being forced through jet 70, and expelled through outlet 72, as indicated by lines 74 and bubbles 74*a* in FIG. 4.

In order to achieve such a pumping action it is necessary that jet 70 be smaller in diameter than the inside diameter of outlet 72. Inlet 73 should be located substantially adjacent to jet 70, preferably so that the downstream end of jet 70 ends approximately on the centerline of inlet 73. Preferably, the inside diameter of inlet 73 is smaller than the inside diameter of outlet 72, although the inside diameter of inlet 73 may be varied to achieve various pumping rates through flexible tube 60. The air and water drawn through tubes 60 and 61 respectively enters the interior of float 20 forcing the float upwardly when the water level within housing 25 reaches a sufficient height relative to the air trapped within float 20.

To prevent the air bubbles 74*a*, which enter float 20 through outlet 72, from bubbling out through the bottom of float 20 and upwardly between float 20 and housing 25, a baffle 48 may be optionally attached to the interior wall of float 20 or 20*a*, as shown in FIGS. 1 thru 3A and FIG. 7. Baffle 48 is located directly below outlet 72 so that water and air being expelled from outlet 72 impinge forcefully upon baffle 48 thereby causing a large portion of the air bubbles to separate from the water stream in which they are entrapped. Since through the use of baffle 48 few or no air bubbles escape upwardly between float 20 and housing 25, or float 20*a* and housing 25*a*, more air is trapped in floats 20 and 20*a*, and they therefore rise much more rapidly. Baffle 48 is rigidly connected to the inner wall of float 20 and 20*a*, and preferably has a slightly concave upper surface upon which the water expelled from outlet 72 impinges.

Figure 5:
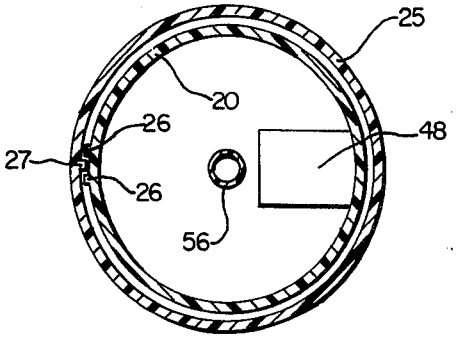
FIG. 5 is a partly sectional view taken along lines 5—5 of FIG. 2.

It is necessary to provide a means for preventing float 20 from rotating within housing 25. To prevent float 20 from rotating within housing 25 there is a track 27 best shown in FIG. 5 rigidly affixed to the interior wall of housing 25 which is slidably received within guides 26 located on the exterior of float 20.

Other suitable means known in the art may be used to prevent rotation of float 20 within housing 25. For example, both housing 25 and float 20 could be elliptical in cross section.

The high rise sprinkler operates in the following manner:

A. Empty or Partly Filled Start

In FIG. 1 sprinkler housing 25 is empty and contains no water. When water is supplied under pressure to pipe 40, water flows upwardly through tube 40*a*, hose 35, through channel 51*a*, channel 51, channel 52, flexible tube 61, inlet 71*a*, jet 70, and is expelled through outlet 72. As explained previously, air is drawn in through flexible tube 60, inlet 73, mixed with water in outlet 72, and is expelled outwardly through outlet 72*a*. Water expelled from outlet 72 thus begins filling the interior of housing 25 or 25*a*, which serve as reservoirs for the water. Water also travels from channel 51 through channel 71 and is expelled through nozzle 75. The water expelled through nozzle 75 is defelected by lid 30 and enlarged portion 24 down between float 20 and housing 25 to fill the interior of housing 25. As the water level within housing 25 rises above the top of notches 42, air is trapped in the interior of float 20 and the pressure of the air trapped therein increases as the level of water rises within housing 25.

The density of the materials from which sprinkler head 15 and float 20 are constructed and the inside diameter of float 20 are selected so that at some point float 20 begins to float upwardly projecting sprinkler head 15 above the surface of the ground, as indicated in FIG. 2. Float 20 stops rising when hose 35 is fully extended.

B. Filled Start

Figure 3A:
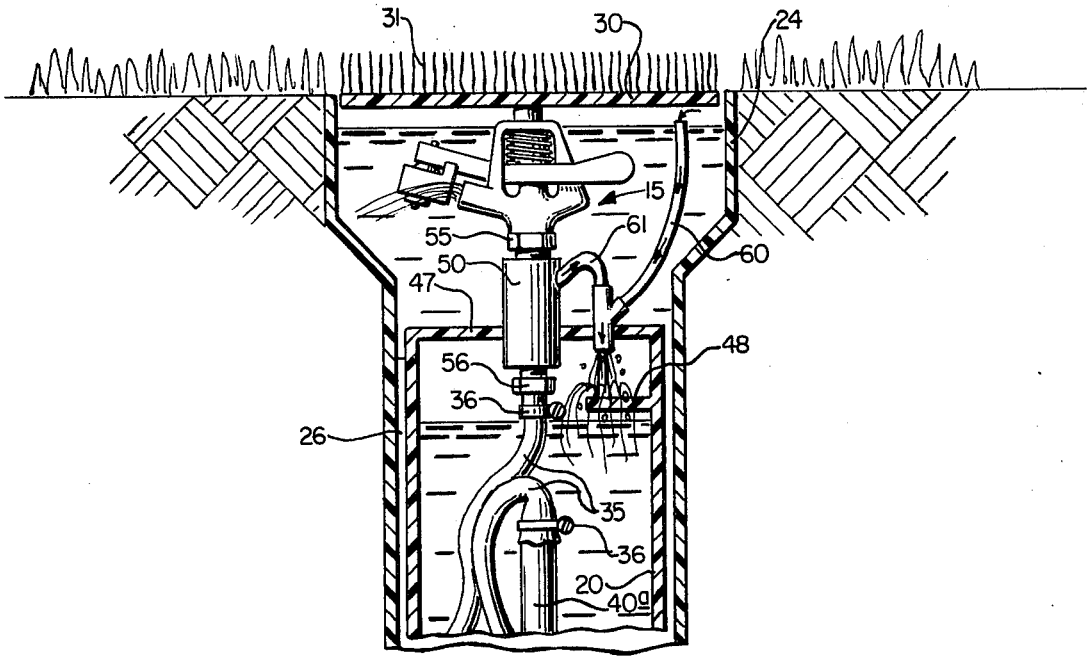
FIG. 3A is a partly sectional side view showing the decrease of the water level in the float when the projectable sprinkler is started in a submerged position filled with water.

In FIG. 3, housing 25 is shown to be filled with water. When water is supplied under pressure to pipe 40, flow occurs as explained above for an empty or partly filled start with the exception that line 60 is beneath the surface of the water momentarily. However, the upward force applied to sprinkler head 15 causes the sprinkler head to rise slightly allowing some small amount of air to enter enlarged portion 24. In addition, water being expelled from nozzle 75 splashes outwardly around the edge of lid 30 forcing some water within enlarged portion 24 outward and onto the surface of the ground surrounding the sprinkler, thereby permitting more air to enter enlarged portion 24. As can be seen in FIG. 3A, the water level within enlarged portion 24 need only drop slightly for the end of line 60 to rise above the water level within portion 24. As soon as the end of line 60 rises above the water level within enlarged portion 24, air will begin to enter or be pumped into the interior of float 20, as indicated in FIG. 3A and as explained previously. Once air begins to enter the interior of float 20 the float will rise as explained above in the explanation of the Empty or Partly Filled Start.

Figure 7:
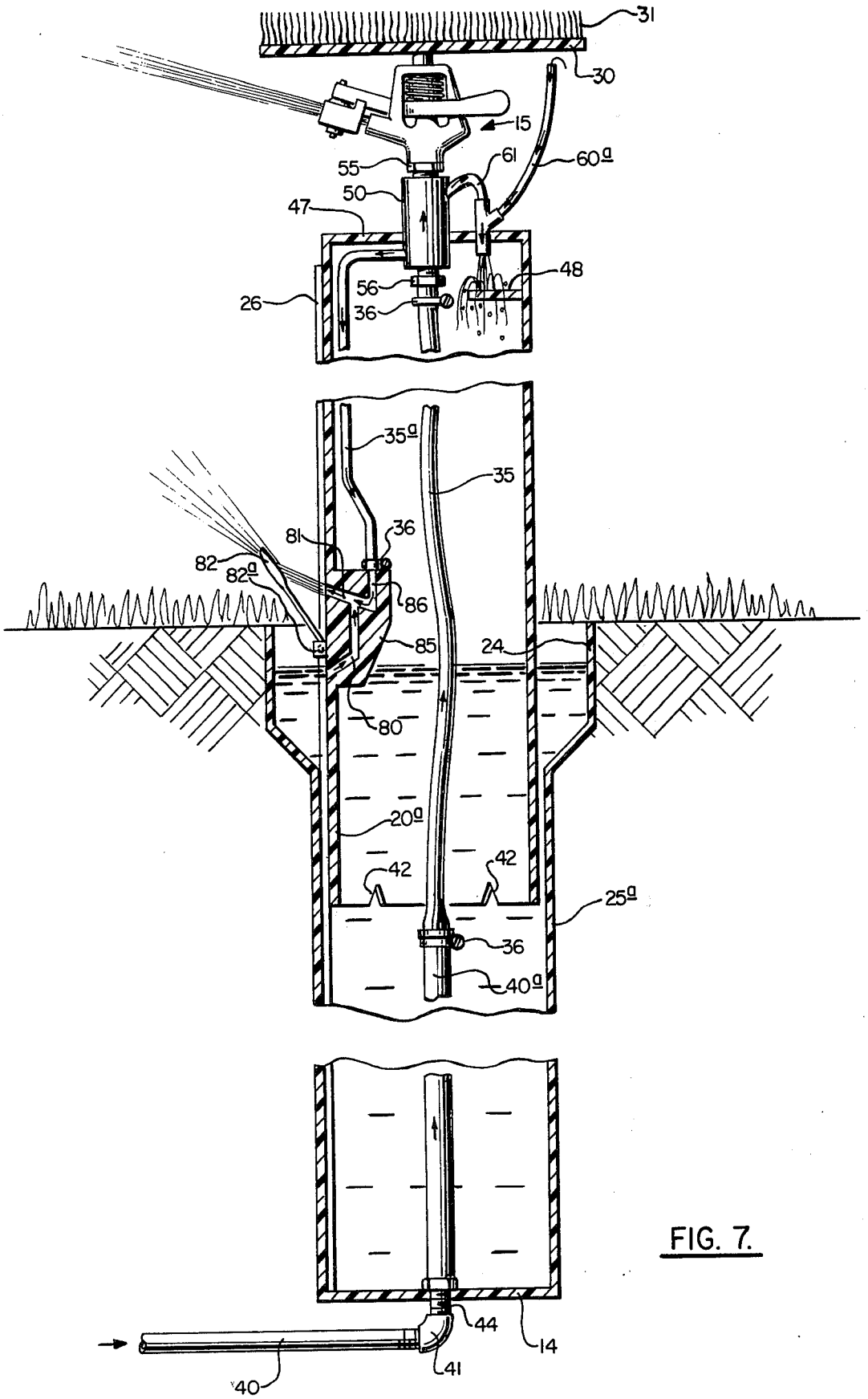

Another embodiment of the high rise sprinkler is shown in FIG. 7. Connected to coupling 50 is a hose 35*a* which extends downward onto fitting 85. Fitting 85 can be seen to contain a downward channel 86 which is connected to an upward turning channel 81. Also joining channel 81 is a downward L-shaped channel 80 which connects channel 81 with the exterior of the housing 25*a*. Connected to the outside of fitting 85 is a valve 82 which is connected by a hinge 82*a* to housing 25*a*.

When float 20*a* is in the retracted position, housing 25 forces valve 82 against float 20 to form a watertight seal with channel 81, thereby stopping any water from flowing outwardly through channel 81. Thus, water entering hose 35*a*travels downward through channel 86 and channel 80 and into the interior of housing 25. After the housing is fully raised, valve 82 is forced open by the water exiting from channel 81, and the low pressure area created at the intersection of channel 81 and channel 80 pumps water from the interior of the housing upward through channel 80 and outward through channel 81. Thus, water is removed from the interior of the housing and sprayed onto the surrounding ground adjacent to the housing, thereby eliminating any water buildup in the area immediately adjacent to the sprinkler.

The various components of the present invention can be constructed from any material desired, such as metals, plastics, and the like, although plastics are preferred because of their generally lower cost. Some parts which have been shown as two elements may be molded from a single piece of plastic, if desired.

It should be understood that air pump means 69 could be replaced with a funnel having its neck or base inserted into the interior of float 20, 20*a*, or bottom 96*a*. Water would flow through tube 61 down into the top of the funnel forcing air and water into the interior of housing 25. However, air pump means 69 is preferred.

Having fully described the present invention, it is desired that it be limited only with the spirit and scope of the following claims.

What is claimed:

1. A projectable law, farm, and orchard sprinkler comprising:

(a) housing means having a top end means and a bottom end means;

(b) projectable float means located in said housing means;

(c) sprinkler head means connected to said projectable float means for spraying fluids;

(d) means connected to said projectable float means for pumping fluids into the interior of said projectable float means to float said projectable float means upward within said housing means, said pump means including:

(i) first inlet means having a first end and a second end for receiving and conveying a stream of liquids from said liquid supply means to outlet means, said first end being connected to said liquid supply means;

(ii) outlet means for discharging fluids into the interior of said projectable float means, said outlet means being connected to said second end of said first inlet means and in substantial alignment therewith, said outlet means having a first end and a second end;

(iii) second inlet means for conveying air to said stream of liquids; and, (iiii) jet forming means including a reduced section means located in the downstream end of said first inlet means and substantially adjacent to the intersection of said second inlet means and said stream of liquids for increasing the velocity of said stream of liquids as said stream of liquids exits from said first inlet means into said outlet means; and, (e) liquid supply means connected to said means for pumping fluids into the interior of said projectable float means and to said sprinkler head means for supplying liquid under pressure to said means for pumping fluids into the interior of said projectable float means and to said sprinkler head means.

2. The sprinkler of claim 1 wherein said housing means is open at the top.

3. The sprinkler of claim 1 wherein said housing means is open at the top and closed at the bottom.

4. The sprinkler of claim 1 wherein said housing means is open at the top end, closed at the bottom end, and is hollow inside.

5. The sprinkler of claim 1 wherein said housing means is generally cylindrical in shape.

6. The sprinkler of claim 1 wherein said projectable float means has a top end means and a bottom end means, said bottom end means being open.

7. The sprinkler of claim 6 wherein said sprinkler head means is connected to said top end means of said projectable float means.

8. The sprinkler of claim 6 wherein said projectable float means has notch means in said bottom end means to reduce wobbling of said projectable float means when air escapes from said bottom end means.

9. The sprinkler of claim 6 wherein said projectable float means has (i) flexible water hose means connected to said top end means and to said bottom end means of said housing means for limiting the height to which said projectable float rises, and (ii) means connected thereto for preventing said projectable float means for rotating in said housing means.

10. The sprinkler of claim 1 wherein said projectable float means has top end means and a bottom end means, said bottom end means being open, said projectable float means being generally hollow inside.

11. The sprinkler of claim 10 wherein said sprinkler head means is connected to said top end of said projectable float means.

12. The sprinkler of claim 1 wherein said sprinkler head means comprises (i) rotary nozzle means for spraying fluids, and (ii) channel means connected to said rotary nozzle means for conveying liquids under pressure from said liquid supply means to said rotary nozzle means.

13. The sprinkler of claim 1 wherein baffle means for separating air from liquids is connected to the inner wall of said projectable float means directly beneath said outlet means so that fluids exiting from said outlet means will impinge thereon.

14. The sprinkler of claim 1 wherein said projectable float means has means connected thereto for pumping fluids from the interior of said housing means after said projectable float means has been projected to its maximum height.

15. A projectable lawn, farm, and orchard sprinkler comprising:

(a) housing means having a top end and a bottom end;

(b) projectable float means located in said housing means, said projectable float means having a top end means and a bottom end means, said bottom end means being open, said projectable float means being generally hollow inside;

(c) sprinkler head means connected to said top end means of said projectable float means for spraying fluids, said sprinkler head means comprising (i) rotary nozzle means for spraying fluid, and (ii) hollow channel means connected to said rotary nozzle means for conveying a stream of liquids to said rotary nozzle means;

(d) means connected to said projectable float means for pumping fluids into the interior of said projectable float means to float said projectable float means upward within said housing means comprising pump means connected to said projectable float means and to liquid supply means for conveying air and liquids under pressure from said liquid supply means to the interior of said projectable float means, said pump means including:

(i) first inlet means having a first end and a second end for receiving and conveying a second stream of liquids from said supply means to outlet means, said first end being connected to said liquid supply means;

(ii) outlet means for discharging fluids into the interior of said projectable float means, said outlet means being connected to said second end of said first inlet means and in substantial alignment therewith, said outlet means having a first end and a second end;

(iii) second inlet means for conveying air to said stream of liquids, and (iiii) jet forming means including a reduced section means located in the downstream end of said first inlet means and substantially adjacent to the intersection of said second inlet means and said stream of liquids for increasing the velocity of said stream of liquids as said stream of liquids exits from said first inlet means into said outlet means; and, (e) liquid supply means for supplying liquid under pressure to said sprinkler head means and to said means for pumping fluids into the interior of said projectable float means, said liquid supply means being connected to said means for pumping fluids into the interior of said projectable float means and to said sprinkler head means.

16. A projectable lawn, farm, and orchard sprinkler comprising:

(a) housing means having a top end means and a bottom end means;

(b) projectable float means located in said housing means, said projectable float means having:

(i) top end means and bottom end means, said bottom end means being open;

(ii) flexible water hose means connected to said top end means and to said bottom end means of said housing means for limiting the height to which said projectable float means rises; and, (iii) means connected thereto for preventing said projectable float means from rotating in said housing means;

(c) sprinkler head means connected to said projectable float means for spraying fluids;

(d) means connected to said projectable float means for pumping fluids into the interior of said projectable float means to float said projectable float means upward within said housing means;

(e) liquid supply means connected to said means for pumping fluids into the interior of said projectable float means and to said sprinkler head means for supplying liquid under pressure to said means for pumping fluids into the interior of said projectable float means and to said sprinkler head means; and, (f) means to said projectable float means for pumping fluids from the interior of said housing means after said projectable float means has been projected to its maximum height.

* * * * *